US009311858B2

(12) United States Patent
Cho et al.

(10) Patent No.: US 9,311,858 B2
(45) Date of Patent: Apr. 12, 2016

(54) CIRCUIT AND METHOD FOR DRIVING OLED DISPLAY

(75) Inventors: Hyun Ho Cho, Incheon-si (KR); Yong Icc Jung, Incheon-si (KR); Young Bok Kim, Busan-si (KR); Joon Ho Na, Daejeon-si (KR); Dae Seong Kim, Daejeon-si (KR); Dae Keun Han, Daejeon-si (KR)

(73) Assignee: SILICON WORKS CO., LTD., Daejeon-Si (KR)

( * ) Notice: Subject to any disclaimer, the term of this patent is extended or adjusted under 35 U.S.C. 154(b) by 1072 days.

(21) Appl. No.: 12/912,223

(22) Filed: Oct. 26, 2010

(65) Prior Publication Data

US 2011/0102410 A1 May 5, 2011

(30) Foreign Application Priority Data

Oct. 30, 2009 (KR) ..... 10-2009-0103954

(51) Int. Cl.
*G09G 3/32* (2006.01)

(52) U.S. Cl.
CPC ..... *G09G 3/3291* (2013.01); *G09G 2300/0819* (2013.01); *G09G 2320/0285* (2013.01); *G09G 2320/0295* (2013.01)

(58) Field of Classification Search
CPC ..... G09G 3/3208; G09G 2320/043; G09G 2310/0251; G09G 2300/0819; G09G 2320/0285; G09G 2320/0295; G09G 3/3291
See application file for complete search history.

(56) References Cited

U.S. PATENT DOCUMENTS

| | | | | |
|---|---|---|---|---|
| 2004/0246224 | A1* | 12/2004 | Tsai et al. | 345/100 |
| 2009/0129151 | A1* | 5/2009 | Roohparvar | 365/185.03 |
| 2009/0184896 | A1* | 7/2009 | Kwon | 345/76 |
| 2009/0251394 | A1* | 10/2009 | Ahn et al. | 345/84 |
| 2010/0225634 | A1* | 9/2010 | Levey et al. | 345/212 |

FOREIGN PATENT DOCUMENTS

| | | |
|---|---|---|
| CN | 1448908 | 10/2003 |
| CN | 1674061 | 9/2005 |
| CN | 100437677 | 11/2008 |
| CN | 101416231 | 4/2009 |
| CN | 101494023 | 7/2009 |
| CN | 101542573 | 9/2009 |
| JP | 2004-70096 | 3/2004 |
| JP | 2006-292848 | 10/2006 |

(Continued)

*Primary Examiner* — Kumar Patel
*Assistant Examiner* — Insa Sadio
(74) *Attorney, Agent, or Firm* — Kile Park Reed & Houtteman PLLC

(57) ABSTRACT

A circuit for driving an organic light emitting diode display includes a display panel that displays an image by using organic light emitting diodes disposed at intersection areas of a plurality of gate lines and a plurality of data lines; a threshold voltage detection control unit that supplies a precharge voltage by sequentially turning on transistors for threshold voltage detection, which are connected among the data lines and the organic light emitting diodes on the display panel, in units of horizontal lines, and enables threshold voltages to be detected; and a source driver that detects threshold voltages of all organic light emitting diodes arranged on a corresponding horizontal line, and repeats an operation, as necessary, for sampling/holding the detected threshold voltages through M sample/hold circuits, converting the sampled/held threshold voltages into digital signals, and storing the digital signals in a memory.

15 Claims, 5 Drawing Sheets

(56) References Cited

FOREIGN PATENT DOCUMENTS

| | | | |
|---|---|---|---|
| JP | 2008-216872 | A | 9/2008 |
| JP | 2009-175652 | A | 8/2009 |
| KR | 10-2000-0035327 | | 6/2000 |
| KR | 10-2005-0109372 | | 11/2005 |
| KR | 1020090080270 | A | 7/2009 |
| TW | 522356 | | 3/2003 |
| TW | I293748 | | 2/2008 |
| TW | 200901134 | | 1/2009 |

* cited by examiner

"PRIOR ART"

CIRCUIT AND METHOD FOR DRIVING OLED DISPLAY

BACKGROUND OF THE INVENTION

1. Field of the Invention

The present invention relates to a technology for driving an OLED (organic light emitting diode) display panel, and more particularly, to a circuit and a method for driving an OLED display, in which a smaller number of sample/hold circuits are used when detecting a change in a threshold voltage of an OLED and performing an automatic compensation process.

2. Description of the Related Art

FIG. 1 is a block diagram schematically illustrating an OLED display in accordance with the related art. Referring to FIG. 1, the OLED display includes a display panel 10, a gate driver 20, a source driver 30, and a threshold voltage detection control unit 40. The display panel 10 displays an image by using pixels 11 arranged at intersection areas of gate lines GL and data lines DL. The gate driver 20 drives the gate lines GL1 to GLn of the display panel 10. The source driver 30 drives the data lines DL1 to DLn of the display panel 10. The threshold voltage detection control unit 40 precharges OLEDs of the display panel 10 and then detects threshold voltages thereof.

In the display panel 10, the pixels 11 including the OLEDs are arranged in a matrix form, and the OLEDs emit light corresponding to data signals supplied from the data lines DL1 to DLn when gate signals are supplied to the gate lines GL1 to GLn.

To this end, the gate driver 20 sequentially supplies the gate signals to the gate lines GL1 to GLn on the display panel 10 to sequentially drive the gate lines GL1 to GLn. The source driver 30 converts digital data signals supplied from an outside into analog data signals, and supplies the analog data signals to the data lines DL1 to DLn in synchronization with the gate signals.

The driving operation of the pixels 11 arranged in the matrix form on the display panel 10 will be described below in more detail.

The gate driver 20 sequentially outputs the gate signals to the gate lines GL1 to GLn of the display panel 10. In synchronization with this, the source driver 30 outputs the data signals to the data lines DL1 to DLn.

Switching transistors TFT-S on the first horizontal line are turned on by the gate signal supplied to the first gate line GL1. Thus, the data signals supplied through the data lines DL1 to DLn are supplied to gates of driving transistors TFT-D through the switching transistors TFT-S, so that the driving transistors TFT-D are turned on. Consequently, a driving current corresponding to the data signals is supplied to the OLEDs through the driving transistors TFT-D, so that the OLEDs emit light with a predetermined brightness. However, the data signals supplied through the switching transistors TFT-S are charged in a capacitor C, which is connected between the gate and source of the driving transistor TFT-D, for one frame time. Therefore, since the driving transistor TFT-D is turned on for one frame, a corresponding OLED continuously emits light for one frame.

Then, since OLEDs on the other horizontal lines sequentially emit light through the above-described process, all OLEDs of the display panel 10 emit light for one frame. Such an operation is continuously performed over a predetermined frame per second.

The OLED produces one of unique colors RGB and produces a target color through a combination with other OLEDs in a unit pixel.

However, the OLEDs gradually deteriorate with the passage of time, resulting in a change in threshold voltages Vth thereof. Therefore, even if the same driving current is supplied to the OLEDs, the brightness of the OLEDs is gradually changed as they are used for a long time.

In this regard, data signals are subject to a compensation process in correspondence with the change in the threshold voltages Vth of the OLEDs, so that the OLEDs always emit light with a constant brightness. Such a conventional threshold voltage compensation operation will be described below with reference to FIG. 2.

In the display panel 10, anodes of OLEDs on each horizontal line are connected to corresponding data lines through transistors TFT-V for threshold voltage detection, respectively. Gates of the transistors TFT-V for threshold voltage detection are commonly connected to threshold voltage compensation control lines CL of the threshold voltage detection control unit 40.

The source driver 30 includes sample/hold circuits S/H1 to S/Hn, which sample/hold the threshold voltages Vth of the OLEDs detected through the transistors TFT-V for threshold voltage detection, provided corresponding to the number of the data lines DL1 to DLn, and an A/D (analog-to-digital) converter 31 for converting the analog threshold voltages sampled/held through the sample/hold circuits S/H1 to S/Hn into digital signals and storing the digital signals in a memory.

Before the OLED display is powered on and an image is displayed on the display panel 10 or in a standby state, the threshold voltage detection control unit 40 sequentially outputs a control signal to the threshold voltage compensation control lines CL1 to CLn installed corresponding to the gate lines (or the horizontal lines) GL1 to GLn, so that the transistors TFT-V for threshold voltage detection on a corresponding horizontal line are sequentially turned on.

When the control signal is supplied to the first threshold voltage compensation control line CL1 and the transistors TFT-V for threshold voltage detection on the first horizontal line are turned on, the source driver 30 outputs precharge voltages to the data lines DL1 to DLn through buffers BUF1 to BUFn. Thus, the precharge voltages are supplied to the anodes of corresponding OLEDs through the transistors TFT-V for threshold voltage detection.

After a predetermined time lapses and the precharge voltages are sufficiently discharged from the OLEDs, the sample/hold circuits S/H1 to S/Hn sample/hold the threshold voltages Vth of the OLEDs which are detected through the transistors TFT-V for threshold voltage detection and a corresponding data line DL. The analog threshold voltages Vth sampled/held in this way are converted into digital signals through the A/D converter 31 and stored in a memory.

Then, the above-described threshold voltage detection operation is sequentially performed with respect to a subsequent horizontal line, and the threshold voltages Vth of corresponding OLEDs are converted into digital signals and stored in the memory through the above-described process.

After the above-described threshold voltage detection operation is completed, in an image display mode of the display panel 10, when data signals corresponding to RGB data supplied from an outside are outputted from the source driver 30 to the OLEDs through the data lines DL1 to DLn, the data signals are outputted after being compensated by variation in the original threshold voltage level with reference to the threshold voltages stored in the memory.

Consequently, the OLEDs always emit light with a constant brightness regardless of a change in the threshold voltages.

However, in the threshold voltage compensation circuit of the conventional OLED display, the sample/hold circuits corresponding to the number of the data lines are used when detecting threshold voltages in order to compensate for the threshold voltages of the OLEDs, resulting in an increase in a chip size and current consumption.

SUMMARY OF THE INVENTION

Accordingly, the present invention has been made in an effort to solve the problems occurring in the related art, and an object of the present invention is to use a smaller number of sample/hold circuits when detecting threshold voltages in order to compensate for the threshold voltages of OLEDs arranged on a display panel of an OLED display.

Multiplexers may be used prior to the sample/hold circuits instead of using the smaller number of sample/hold circuits.

In order to achieve the above object, according to one aspect of the present invention, there is provided a circuit for driving an organic light emitting diode display, including: a display panel that displays an image by using organic light emitting diodes disposed at intersection areas of a plurality of gate lines and a plurality of data lines; a threshold voltage detection control unit that supplies a precharge voltage by sequentially turning on transistors for threshold voltage detection, which are connected among the data lines and the organic light emitting diodes on the display panel, in units of horizontal lines, and enables threshold voltages to be detected; and a source driver that detects threshold voltages of all organic light emitting diodes arranged on a corresponding horizontal line in such a manner that k data lines of the data lines are connected to input channels of M multiplexers and data lines are sequentially connected to one horizontal line k times, and repeats an operation, as necessary, for sampling/holding the detected threshold voltages through M sample/hold circuits, converting the sampled/held threshold voltages into digital signals, and storing the digital signals in a memory.

According to another aspect of the present invention, there is provided a method for driving an organic light emitting diode display, including: precharging organic light emitting diodes on a currently selected horizontal line through data lines and reading M threshold voltages through a first channel by using M multiplexers for sample/hold which include input channels connected to k data lines; sampling/holding the read M threshold voltages through sample/hold circuits corresponding to the M multiplexers for sample/hold in a one-to-one manner, converting the sampled/held threshold voltages into digital signals through an analog-to-digital converter, and storing the digital signals in a memory; sequentially reading threshold voltages through second to $k^{th}$ channels by controlling a switching operation of the M multiplexers for sample/hold, sampling/holding the read threshold voltages, converting the sampled/held threshold voltages into digital signals, and storing the digital signals in the memory; reading threshold voltages of organic light emitting diodes arranged on a first horizontal line through the above steps, storing the read threshold voltages in the memory, and storing threshold voltages of all organic light emitting diodes arranged on a display panel in the memory by repeating the above steps for organic light emitting diodes arranged on subsequent horizontal lines; and compensating and outputting data signals based on the threshold voltages of the organic light emitting diodes, which are stored in the memory, when displaying an image by driving the display panel.

BRIEF DESCRIPTION OF THE DRAWINGS

The above objects, and other features and advantages of the present invention will become more apparent after a reading of the following detailed description taken in conjunction with the drawings, in which.

DETAILED DESCRIPTION OF PREFERRED EMBODIMENTS

Reference will now be made in greater detail to a preferred embodiment of the present invention, an example of which is illustrated in the accompanying drawings.

Figure 1:
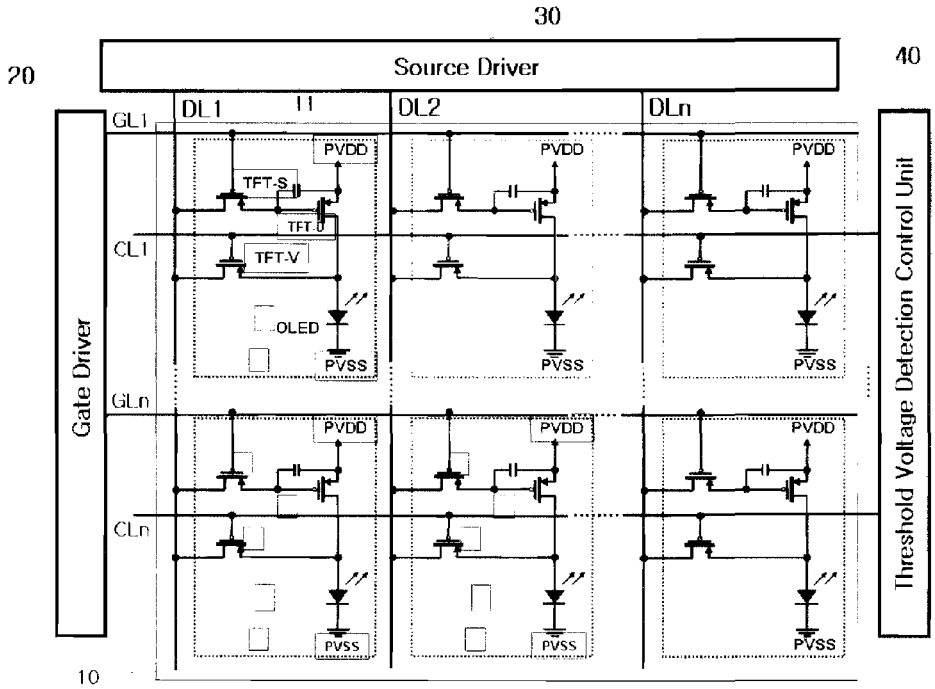
FIG. 1 is a block diagram schematically illustrating an OLED display in accordance with the related art.
Figure 2:
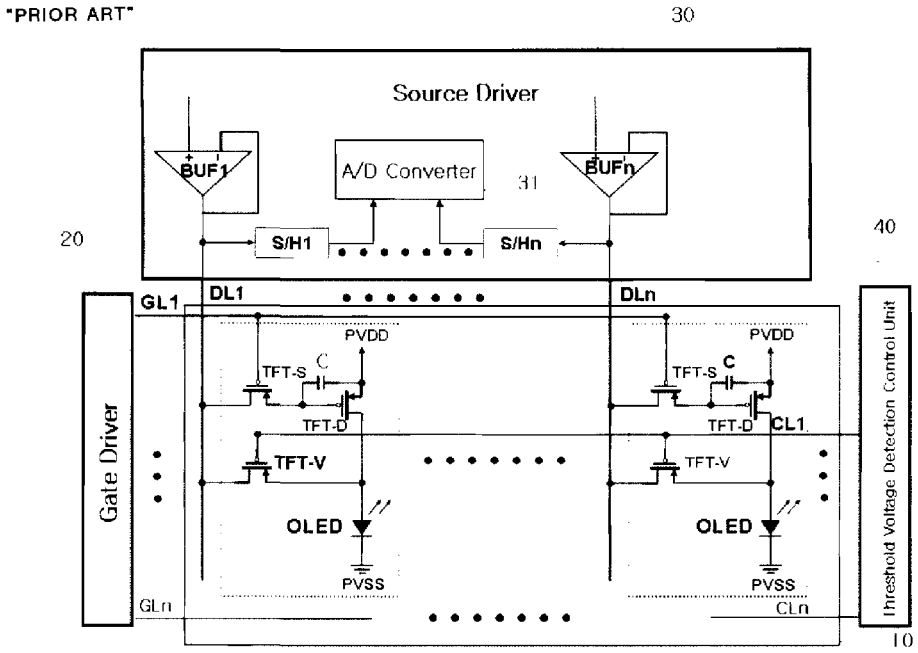
FIG. 2 is a block diagram of an OLED display in accordance with the related art.
Figure 3:
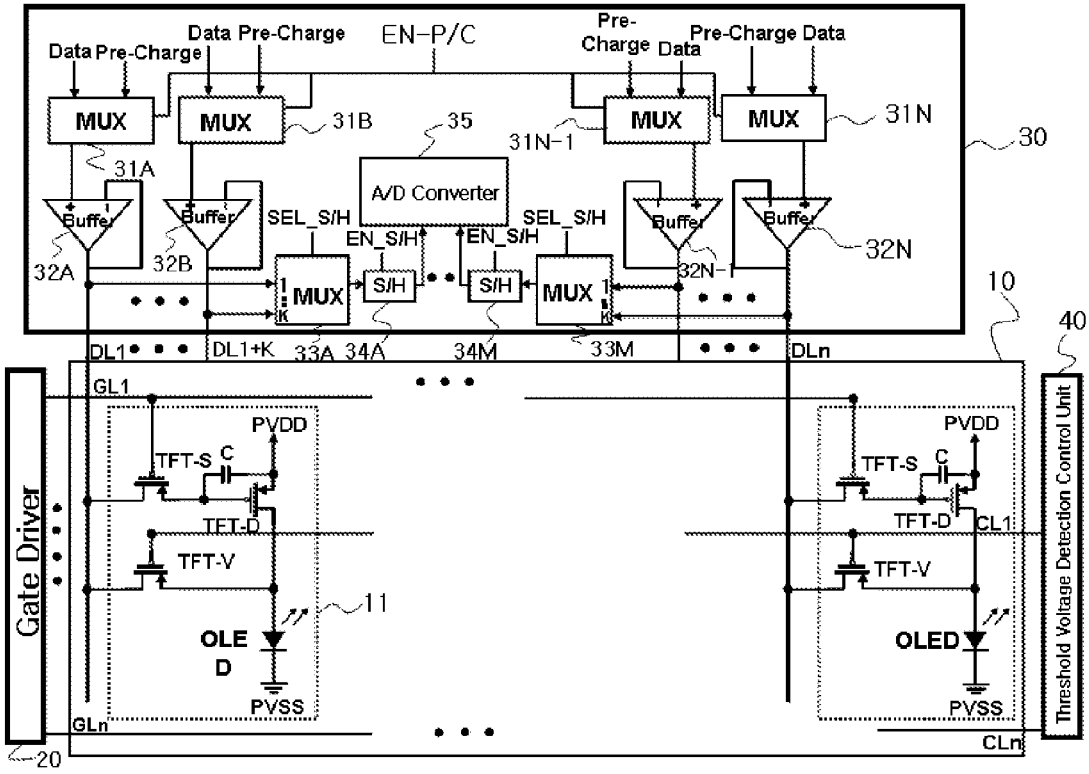
FIG. 3 is a block diagram of a circuit for driving an OLED display in accordance with an embodiment of the present invention.

FIG. 3 is a block diagram of a circuit for driving an OLED display in accordance with an embodiment of the present invention. Referring to FIG. 3, the driving circuit includes a display panel 10, a gate driver 20, a source driver 30, and a threshold voltage detection control unit 40.

The source driver 30 includes N multiplexers 31A to 31N for input, N buffers 32A to 32N, M multiplexers 33A to 33M for sample/hold, M sample/hold circuits 34A to 34M, and an A/D converter 35.

In the case of displaying an image, the gate driver 20 sequentially outputs gate signals to gate lines GL1 to GLn of the display panel 10. In synchronization with this, the source driver 30 outputs data signals Data to data lines DL1 to DLn through the multiplexers 31A to 31N for input and the buffers 32A to 32N.

First, switching transistors TFT-S on the first horizontal line are turned on by the gate signal supplied to the first gate line GL1. Thus, the data signals Data supplied through the data lines DL1 to DLn are supplied to gates of driving transistors TFT-D through the switching transistors TFT-S, so that the driving transistors TFT-D are turned on. Consequently, a driving current corresponding to the data signals Data is supplied to the OLEDs through the driving transistors TFT-D, so that the OLEDs emit light with a predetermined brightness.

However, the data signals Data supplied through the switching transistors TFT-S are charged in a capacitor C, which is connected between the gate and source of the driving transistor TFT-D, for one frame time. Therefore, since the driving transistor TFT-D is turned on for one frame, a corresponding OLED continuously emits light for one frame.

Then, since the OLEDs on the other horizontal lines sequentially emit light through the above-described process, all OLEDs of the display panel 10 emit light for one frame. Such an operation is continuously performed over a predetermined frame per second.

The OLED produces one of unique colors RGB and produces a target color through a combination with other OLEDs in a unit pixel.

However, the OLEDs gradually deteriorate with the passage of time, resulting in a change in threshold voltages Vth thereof. Therefore, even if the same driving current is supplied to the OLEDs, the brightness level of the OLEDs is gradually reduced as they are used for a long time.

Figure 4:
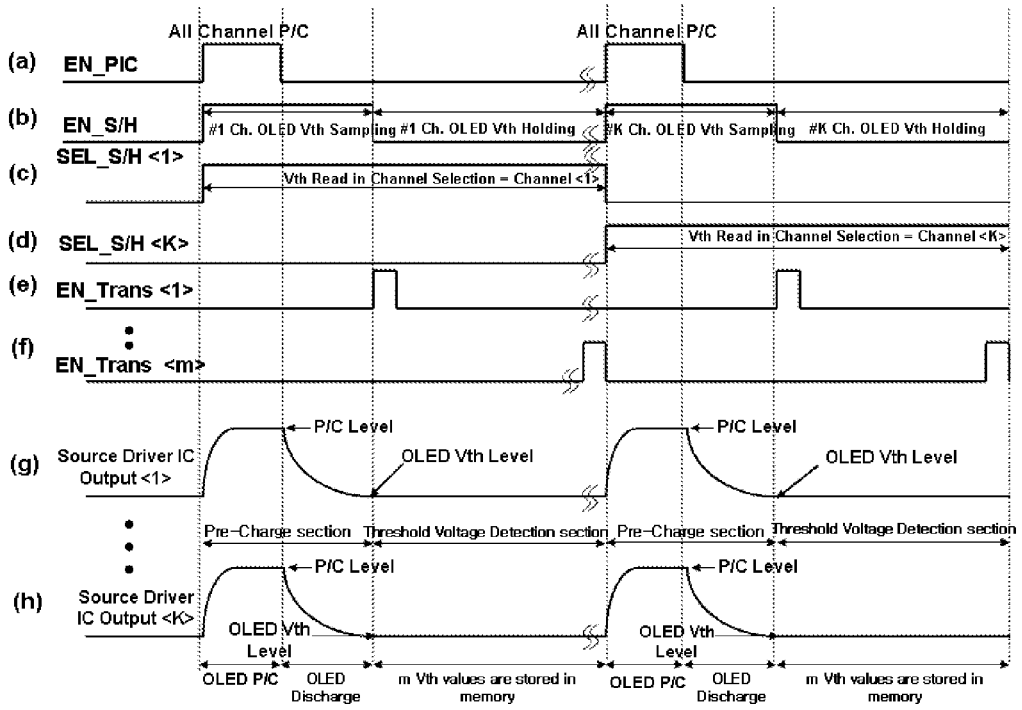
FIGS. 4A to 4H are diagrams illustrating waveforms of each element illustrated in FIG. 3.

In this regard, the change in the threshold voltages Vth of the OLEDs is detected, data signals are subject to a compensation process according to the detection result such that the OLEDs always emit light with a constant brightness. The threshold voltage detection operation in accordance with the embodiment of the present invention will be described below with reference to FIG. 4.

Before the OLED display is powered on and an image is displayed on the display panel 10 or in a standby state, the threshold voltage detection control unit 40 sequentially outputs a control signal to threshold voltage compensation control lines CL1 to CLn arranged corresponding to the gate lines (or the horizontal lines) GL1 to GLn, so that transistors TFT-V for threshold voltage detection on a corresponding horizontal line are sequentially turned on.

First, the control signal is supplied to the first threshold voltage compensation control line CL1 and the transistors TFT-V for threshold voltage detection on the first horizontal line are turned on.

In such a state, the source driver 30 supplies the multiplexers 31A to 31N for input with a first precharge enable signal EN_P/C illustrated in FIG. 4A. Thus, the precharge voltages Pre-Charge illustrated in FIG. 4G are transmitted to OLEDs located on the first horizontal line on the display panel 10 through the multiplexers 31A to 31N for input, the buffers 32A to 32N, the data lines DL1 to DLn and the transistors TFT-V for threshold voltage detection, and are precharged therein. The sample/hold selection signal SEL_S/H illustrated in FIG. 4C is supplied to the multiplexers 33A to 33M for sample/hold. The precharge voltage may be set to be higher than the original threshold voltages of the OLEDs.

Meanwhile, the total M multiplexers 33A to 33M for sample/hold are provided with respect to the N data lines DL1 to DLn in such a manner that one multiplexer for sample/hold corresponds to K data lines. The multiplexers 33A to 33M for sample/hold sequentially select input by using the sample/hold selection signal SEL_S/H and output the selected input.

In such a state, the multiplexers 33A to 33M for sample/hold select threshold voltages Vth, which are inputted through first input terminals thereof, among the threshold voltages Vth of the OLEDs which are inputted through the transistors TFT-V for threshold voltage detection and the data lines, and output the selected threshold voltages to the sample/hold circuits 34A to 34M.

The sample/hold circuits 34A to 34M receive the sample/hold enable signal EN_S/H illustrated in FIG. 4B and sample/hold the inputted threshold voltages. The sample/hold circuits 34A to 34M output the sampled/held threshold voltages to the A/D converter 35 in synchronization with the transmission enable signal EN_Trans illustrated in FIG. 4E. The A/D converter 35 converts the sampled/held threshold voltages inputted from the sample/hold circuits 34A to 34M into digital signals, and the converted threshold voltages are stored in a memory.

Then, the source driver 30 supplies the multiplexers 31A to 31N for input with a second precharge enable signal EN_P/C. Thus, the precharge voltages Pre-Charge are transmitted to the OLEDs located on the first horizontal line on the display panel 10 and are precharged therein. The sample/hold selection signal SEL_S/H is supplied to the multiplexers 33A to 33M for sample/hold. The multiplexers 33A to 33M for sample/hold select threshold voltages Vth inputted through second input terminals thereof, and output the selected threshold voltages Vth to the sample/hold circuits 34A to 34M. The selected threshold voltages Vth are sampled/held through the sample/hold circuits 34A to 34M as described above, are converted into digital signals through the A/D converter 35, and are stored in the memory.

Then, the above-described operation is repeated, so that the sample/hold circuits 34A to 34M select threshold voltages Vth inputted through $k^{th}$ input terminals thereof and the selected threshold voltages Vth are stored in the memory through the above-described process. In this way, the threshold voltage detection operation for the OLEDs of one horizontal line is completed.

Next, threshold voltages Vth are detected with respect to the OLEDs of a second horizontal line to the final horizontal line and stored in the memory through the above-described process. In this way, the threshold voltage detection operation is completed.

Then, when data signals are outputted from the source driver 30 in a normal operation mode of the display panel 10, the data signals are outputted after being compensated by variation in the original threshold voltage level with reference to the threshold voltages of the OLEDs which are stored in the memory. Consequently, the OLEDs always emit light with a constant brightness regardless of a change in the threshold voltages thereof.

In relation to the threshold voltage selection operation of the sample/hold circuits 34A to 34M, when the total number of the data lines of the display panel 10 is 9 (DL1 to DL9) and the total three multiplexers for sample/hold are used by allocating one multiplexer for sample/hold to three data lines, a process for detecting the threshold voltages Vth of the OLEDs on the first horizontal line will be described below as an example.

After the first precharge enable signal EN_P/C is supplied, the first multiplexer for sample/hold selects and outputs a threshold voltage Vth inputted through the data line DL1, the second multiplexer for sample/hold selects and outputs a threshold voltage Vth inputted through the data line DL4, and the third multiplexer for sample/hold selects and outputs a threshold voltage Vth inputted through the data line DL7.

After the second precharge enable signal EN_P/C is supplied, the first multiplexer for sample/hold selects and outputs a threshold voltage Vth inputted through the data line DL2, the second multiplexer for sample/hold selects and outputs a threshold voltage Vth inputted through the data line DL5, and the third multiplexer for sample/hold selects and outputs a threshold voltage Vth inputted through the data line DL8.

After the third precharge enable signal EN_P/C is supplied, the first multiplexer for sample/hold selects and outputs a threshold voltage Vth inputted through the data line DL3, the second multiplexer for sample/hold selects and outputs a threshold voltage Vth inputted through the data line DL6, and the third multiplexer for sample/hold selects and outputs a threshold voltage Vth inputted through the data line DL9.

When X source drivers are necessary in order to drive the OLED display panel 10, the X source drivers simultaneously detect the threshold voltages of the OLEDs through the above-described process. When the number of the horizontal lines of the display panel 10 is Y, the X source drivers repeats a threshold voltage detection operation Y times, thereby detecting the threshold voltages of all OLEDs on the display panel 10.

So far, an example in which the threshold voltages of the OLEDs detected once are sampled/held and converted into digital signals for storage has been described. However, for the improvement of reliability, an average value of threshold voltages detected plural times (e.g., twice or more) may be calculated, sampled/held and converted into digital signals for storage.

Figure 5:
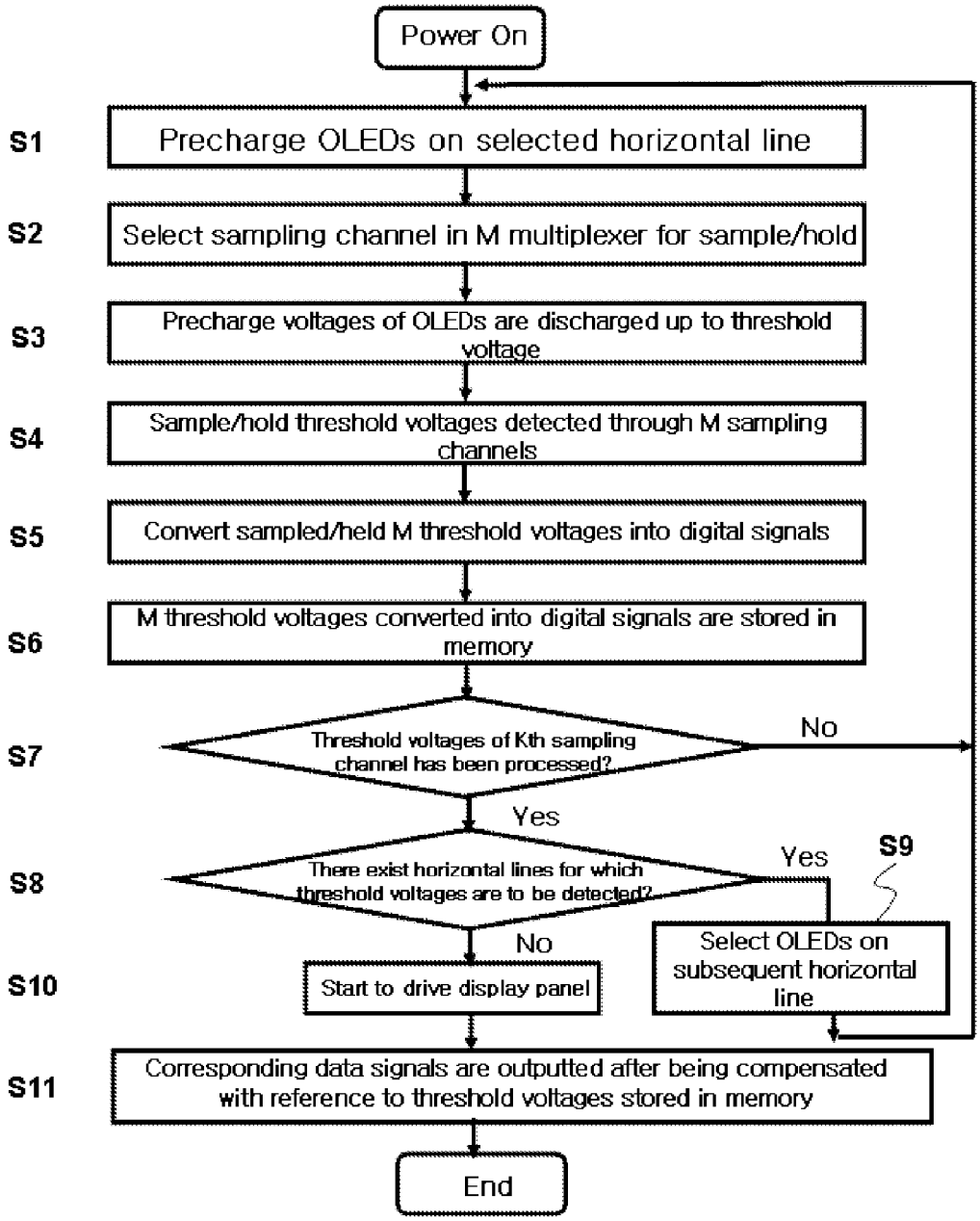
FIG. 5 is a control flowchart illustrating a method for driving an OLED display in accordance with an embodiment of the present invention.

FIG. 5 is a flowchart illustrating a method for driving the OLED display in accordance with the embodiment of the present invention, which will be described below.

The threshold voltage detection control unit turns on the transistors for threshold voltage detection of the first horizontal line. In such a state, the source driver outputs precharge voltages. The precharge voltage are transmitted to the OLEDs located on the first horizontal line through the data lines DL1 to DLn and the transistors for threshold voltage detection, and are precharged therein (S1).

The source driver outputs the sample/hold selection signal such that the M multiplexers for sample/hold select first channels (S2).

The precharge voltages of the OLEDs located on the first horizontal line are discharged up to a threshold voltage for a predetermined time (S3).

M threshold voltages, which are connected to the first channels of the multiplexers for sample/hold, are read among the threshold voltages of the OLEDs located on the first horizontal line, and are sampled/held through the M sample/hold circuits (S4).

The sampled/held M threshold voltages are converted into digital signals trough the A/D converter and stored in the memory (S5 and S6).

It is determined whether the threshold voltage of a $k^{th}$ sampling channel has been processed. When it is determined that the threshold voltage of the $k^{th}$ sampling channel has not been processed, the next channel is selected through the M multiplexers for sample/hold, and an operation for converting M threshold voltages connected to a corresponding channel into digital signals and storing the digital signals in the memory as described above is repeated, so that the threshold voltages of the OLEDs on one horizontal line are stored in the memory (S7).

The threshold voltages of the OLEDs arranged on the first horizontal line are read and stored in the memory through the above-described process, and then the above process is repeated for OLEDs arranged on the next horizontal line, so that the threshold voltages of all OLEDs arranged on the display panel are stored in the memory (S8 and S9).

Thereafter, the display panel is driven to display an image. At this time, data signals are outputted after being compensated by variation in the threshold voltage of each OLED, which is stored in the memory, with respect to the original threshold voltage (S10 and S11).

The present invention does not detect threshold voltages of OLEDs by using sample/hold circuits provided corresponding to all data lines. Instead, k data lines are selectively connected through a predetermined number of multiplexers and detected threshold voltages are sampled/held through corresponding sample/hold circuits, so that the number of sample/hold circuits used can be significantly reduced, resulting in the reduction in a chip size and power consumption.

Although a preferred embodiment of the present invention has been described for illustrative purposes, those skilled in the art will appreciate that various modifications, additions and substitutions are possible, without departing from the scope and the spirit of the invention as disclosed in the accompanying claims.

What is claimed is:

1. A circuit for driving an organic light emitting diode display, comprising:

a source driver that provides data signals to organic light emitting diodes of a display panel and detects variation in threshold voltages of the organic light emitting diodes to compensate the data signals based on the detected threshold voltages, wherein the source driver comprises:

N multiplexers for input that selectively output data signals or precharge voltages;

N buffers that buffer the data signals or the precharge voltages which are outputted from the N multiplexers for input, and output the buffered data signals or precharge voltages to data lines;

M multiplexers for sample/hold each including input channels connected to k data lines of the data lines and at least one output terminal to which the input channels are sequentially connected, wherein the input channels receive threshold voltages of organic light emitting diodes through the k data lines from the organic light emitting diodes, and a selected threshold voltage is outputted through the at least one output terminal; and M sample/hold circuits each connected with the at least one output terminal of corresponding one of the M multiplexers for sample/hold to sample/hold the selected threshold voltage provided from the corresponding one of the M multiplexers for sample/hold, wherein 'M' is greater than one and less than 'N'.

2. The circuit for driving an organic light emitting diode display according to claim 1, wherein the source driver is provided in plurality.

3. The circuit for driving an organic light emitting diode display according to claim 2, wherein the plurality of source drivers simultaneously detect the threshold voltages of the organic light emitting diodes.

4. The circuit for driving an organic light emitting diode display according to claim 1, wherein the source driver performs an operation for detecting and sampling/holding the threshold voltages of the organic light emitting diodes, converting the sampled/held threshold voltages into the digital signals, and storing the digital signals in a memory with respect to one horizontal line k times, and repeats the operation for one frame by the number of horizontal lines of a display panel.

5. The circuit for driving an organic light emitting diode display according to claim 1, further comprising a threshold voltage detection control unit that enables threshold voltages to be detected by sequentially turning on transistors for threshold voltage detection, which are connected among the data lines and the organic light emitting diodes on the display panel.

6. The circuit for driving an organic light emitting diode display according to claim 1, further comprising an analog-to-digital converter that converts the threshold voltages of the organic light emitting diodes, which are sampled/held by the M sample/hold circuits, into digital signals.

7. The circuit for driving an organic light emitting diode display according to claim 6, wherein the analog-to-digital converter sequentially converts M threshold voltages of organic light emitting diodes, which are sampled/held by the M sample/hold circuits, into digital signals whenever a one-time precharge operation is performed.

8. The circuit for driving an organic light emitting diode display according to claim 1, wherein the precharge voltage is higher than an original threshold voltage of the organic light emitting diode.

9. The circuit for driving an organic light emitting diode display according to claim 1, wherein the precharge voltages are simultaneously outputted to all data lines.

10. The circuit for driving an organic light emitting diode display according to claim 1, wherein the N multiplexers for input select and output precharge voltages whenever the M multiplexers for sample/hold perform a switching operation.

11. The circuit for driving an organic light emitting diode display according to claim 1, wherein the M multiplexers for sample/hold sequentially select the k input channels and connect the k input channels to the output terminals whenever a sample/hold selection signal is inputted.

12. The circuit for driving an organic light emitting diode display according to claim 1, wherein the M sample/hold circuits correspond to the output terminals of the M multiplexers for sample/hold in a one-to-one manner.

13. The circuit for driving an organic light emitting diode display according to claim 1, wherein the M multiplexers for sample/hold each select one of the threshold voltages received though the k data lines in response to a selection control signal to output the selected threshold voltage.

14. A method for driving an organic light emitting diode display, comprising:

precharging organic light emitting diodes on a currently selected horizontal line through N data lines;

reading M threshold voltages provided from data lines through a first channel from the light emitting diodes by using M multiplexers for sample/hold each of which includes input channels connected to k data lines;

sampling/holding the read M threshold voltages provided from the M multiplexers for sample/hold in sample/hold circuits corresponding to the M multiplexers for sample/hold in a one-to-one manner;

converting the sampled/held threshold voltages into digital signals through an analog-to-digital converter, and storing the digital signals in a memory;

sequentially reading threshold voltages through second to kth channels from the light emitting diodes by controlling a switching operation of the M multiplexers, sampling/holding the read threshold voltages, converting the sampled/held threshold voltages into digital signals, and storing the digital signals in the memory;

reading threshold voltages of organic light emitting diodes arranged on a first horizontal line through the above steps, storing the read threshold voltages in the memory, and storing threshold voltages of all organic light emitting diodes arranged on a display panel in the memory by repeating the above steps for organic light emitting diodes arranged on subsequent horizontal lines; and compensating and outputting data signals based on the threshold voltages of the organic light emitting diodes, which are stored in the memory, when displaying an image by driving the display panel;

wherein the data signals are outputted after being compensated based on an average value of threshold voltages detected in plural times, and wherein 'M' is greater than one and less than 'N'.

15. The method for driving an organic light emitting diode display according to claim 14, further comprising:

selecting one of the input channels in response to a selection control signal to read one of the M threshold voltages provided through a selected one of the input channels; and sampling/holing the read one of the M threshold voltages in the sample/hold circuits in response to another selection control signal.

* * * * *